US009791105B2

(12) United States Patent
Whiteman et al.

(10) Patent No.: US 9,791,105 B2
(45) Date of Patent: Oct. 17, 2017

(54) SYSTEM AND METHOD FOR REFUELLING COMPRESSED GAS PRESSURE VESSELS USING A LIQUID PISTON

(71) Applicant: Mosaic Technology Development Pty. Ltd., Brisbane, Queensland (AU)

(72) Inventors: Paul Anthony Whiteman, Brisbane (AU); Derek Shane Fekete, Brisbane (AU)

(73) Assignee: Mosaic Technology Development Pty, Ltd., Brisbane, Queensland (AU)

( * ) Notice: Subject to any disclaimer, the term of this patent is extended or adjusted under 35 U.S.C. 154(b) by 57 days.

(21) Appl. No.: 14/649,881

(22) PCT Filed: Dec. 10, 2013

(86) PCT No.: PCT/AU2013/001433
§ 371 (c)(1),
(2) Date: Jun. 4, 2015

(87) PCT Pub. No.: WO2014/089608
PCT Pub. Date: Jun. 19, 2014

(65) Prior Publication Data

US 2015/0354754 A1 Dec. 10, 2015

(30) Foreign Application Priority Data

Dec. 10, 2012 (AU) ..... 2012905411

(51) Int. Cl.
*B65B 1/04* (2006.01)
*F17C 5/06* (2006.01)
*F17C 5/00* (2006.01)

(52) U.S. Cl.
CPC ..... *F17C 5/06* (2013.01); *F17C 5/007* (2013.01); *F17C 2201/0109* (2013.01); *F17C 2201/032* (2013.01); *F17C 2201/054* (2013.01); *F17C 2205/0341* (2013.01); *F17C 2221/033* (2013.01); *F17C 2223/0123* (2013.01);
(Continued)

(58) Field of Classification Search
CPC ..... F17C 5/06; F17C 7/02; F17C 1/12
See application file for complete search history.

(56) References Cited

U.S. PATENT DOCUMENTS 1,938,956 A 12/1933 Fee
4,209,271 A 6/1980 McCabe et al.
(Continued)

FOREIGN PATENT DOCUMENTS

GB 1170294 11/1969

*Primary Examiner* — Jason K Niesz
(74) *Attorney, Agent, or Firm* — Diederiks & Whitelaw, PLC

(57) ABSTRACT

A pressure vessel refueling system enables fast refueling of Compressed Natural Gas (CNG) fuel tanks. The system includes a pressure vessel having a gas inlet/outlet port and a liquid inlet/outlet port; a first liquid at least partially filling the pressure vessel; a liquid layer of a second liquid floating on top of the first liquid, wherein the second liquid is immiscible with the first liquid; a gas at least partially filling the pressure vessel above the liquid layer of the second liquid, the gas in fluid communication with the gas inlet/outlet; and a pump in fluid communication with the liquid inlet/outlet of the pressure vessel, whereby the first liquid can be pumped or returned to/from storage into or out of the pressure vessel.

11 Claims, 3 Drawing Sheets

(52) U.S. Cl.
CPC *F17C 2223/033* (2013.01); *F17C 2225/0123* (2013.01); *F17C 2225/036* (2013.01); *F17C 2227/0192* (2013.01); *F17C 2260/035* (2013.01); *F17C 2270/0139* (2013.01)

(56) References Cited

U.S. PATENT DOCUMENTS

| | | | | |
|---|---|---|---|---|
| 4,805,674 | A * | 2/1989 | Knowlton | F17C 5/06 141/39 |
| 5,454,408 | A | 10/1995 | DiBella et al. | |
| 6,439,278 | B1 | 8/2002 | Krasnov | |
| 2008/0041068 | A1 | 2/2008 | Horton et al. | |
| 2008/0127654 | A1 | 6/2008 | Darling et al. | |
| 2010/0139777 | A1 | 6/2010 | Whiteman | |

* cited by examiner

SYSTEM AND METHOD FOR REFUELLING COMPRESSED GAS PRESSURE VESSELS USING A LIQUID PISTON

CROSS-REFERENCE TO RELATED APPLICATIONS

This application represents a National Stage application of PCT/AU2013/001433 entitled "System and Method for Refueling Compressed Gas Pressure Vessels Using a Liquid Piston" filed Dec. 10, 2013, pending.

FIELD OF THE INVENTION

This invention relates generally to a compressed gas transfer system. In particular, the invention relates to a compressed natural gas (CNG) transfer system including a method of storing and delivering CNG at a controlled pressure using a liquid piston.

BACKGROUND OF THE INVENTION

Natural gas fuels are relatively environmentally friendly for use in vehicles, and hence there is support by environmental groups and governments for the use of natural gas fuels in vehicle applications. Natural gas based fuels are commonly found in three forms: Compressed Natural Gas (CNG), Liquefied Natural Gas (LNG) and a derivative of natural gas called Liquefied Petroleum Gas (LPG).

Natural gas fuelled vehicles have impressive environmental credentials as they generally emit very low levels of $SO_2$ (sulphur dioxide), soot and other particulate matter. Compared to gasoline and diesel powered vehicles, $CO_2$ (carbon dioxide) emissions of natural gas fuelled vehicles are often low due to a more favourable carbon-hydrogen ratio found in natural gas. Natural gas vehicles come in a variety of forms, from small cars to buses and increasingly to trucks in a variety of sizes. Natural gas fuels also provide engines with a longer service life and lower maintenance costs. Further, CNG is the least expensive alternative fuel when comparing equal amounts of fuel energy. Still further, natural gas fuels can be combined with other fuels, such as diesel, to provide similar benefits mentioned above.

A key factor limiting the use of natural gas in vehicles is the storage of the natural gas fuel. In the case of CNG and LNG, the fuel tanks are generally expensive, large and cumbersome relative to tanks required for conventional liquid fuels having equivalent energy content. In addition, the relative lack of wide availability of CNG and LNG refueling facilities, and the cost of LNG, add further limitations on the use of natural gas as a motor vehicle fuel. Further, in the case of LNG, the cost and complexity of producing LNG and issues associated with storing a cryogenic liquid on a vehicle further limits the widespread adoption of this fuel.

Some of the above issues are mitigated when using LPG and this fuel is widely used in high mileage motor cars such as taxis. However, cost versus benefit comparisons are often not favourable in the case of private motor cars. Issues associated with the size and shape of the fuel tank, the cost variability of LPG and the sometimes limited supply mean that LPG also has significant disadvantages that limit its widespread adoption. In summary, unless there is massive investment in a network of LNG plants around major transport hubs, CNG is the only feasible form of natural gas that is likely to be widely utilised in the near future.

Further; although LNG has had some success as a liquid fuel replacement in some regions of the world, the lack of availability of LNG and its high cost means that in many regions of the world it is not feasible to use LNG. In the case of CNG, it also has had some success as a liquid fuel replacement but almost exclusively in spark ignition engines utilising the low pressure carburetted port injection induction technology. This application is popular in government bus fleets around the world where the cleaner burning natural fuel is used in a spark ignition engine fitted in place of a conventional diesel engine. The application is usually a limited range fleet and includes a buffer CNG fill strategy with overnight refueling of the fleet.

However, the circumstances for broad implementation of CNG in large vehicles are limited by this buffer fill strategy, which essentially delivers gas at only the capacity of the compressor with any gas storage acting as a buffer to minimise compressor on/off cycling. Thus CNG has been seen as having limitations due to the size of incoming gas connections and electrical power requirements to meet intermittent and peak demands at refueling stations.

For example, a typical requirement for refueling a CNG vehicle is 10 diesel gallons equivalent per minute. If 4 vehicles were to be refueled simultaneously, on a site with 4 dispensers, this would require up to 2000 kW of compression and a correspondingly large gas interconnection, if using typical US industry CNG industrial gas supply connection pressures.

U.S. Pat. No. 4,805,674 to Knowlton discloses a "fast-fill" natural gas storage and retrieval system that overcomes some of the above described problems regarding the need for significant energy to compress natural gas from the relatively low pressure of utility supply lines to the on-vehicle storage pressures of around 3600 psig. Knowlton uses a natural gas displacing liquid to effectively vary the volume of a primary CNG storage vessel.

However, the disclosure of Knowlton presents several problems regarding gas loss and gas contamination. For example, if the displacing liquid is an aqueous liquid, the CNG can become contaminated with water, which requires expensive gas drying processes when the gas is expelled for use. Further, alternative displacing liquids can become contaminated by the CNG dissolving into the liquid. The dissolved CNG then can be lost when the displacing liquid is removed from the CNG storage vessel to a low-pressure liquid storage tank.

Ionic liquids, i.e., a salt in liquid state with low vapour pressure, have been trialed with CNG displacement in micro scale compressors, but these solutions are expensive, often flammable, and have high environmental toxicity—and thus do not scale to large installations.

Further various solutions of hydrocarbon type oils have been trialed with poor results, as these solutions take up a substantial quantity of gas in solution, which presents a problem with gas recovery and otherwise loss when the solution is returned to a low-pressure liquid storage tank.

Also, gas and liquid isolation inside pressure vessels has been attempted using physical bladders or mechanical pistons; however problems with cost, complexity, scaling, fabrication and maintenance have made these potential solutions problematic.

Therefore, there is a need for an improved system and method for refueling compressed gas pressure vessels.

Object of the Invention

It is an object of some embodiments of the present invention to provide consumers with improvements and advantages over the above described prior art, and/or overcome and alleviate one or more of the above described disadvantages of the prior art, and/or provide a useful commercial choice.

SUMMARY OF THE INVENTION

In one form, although not necessarily the only or broadest form, the invention resides in a pressure vessel refueling system comprising:

a pressure vessel having a gas inlet/outlet port and a liquid inlet/outlet port;

a first liquid at least partially filling the pressure vessel;

a liquid layer of a second liquid floating on top of the first liquid, wherein the second liquid is immiscible with the first liquid;

a gas at least partially filling the pressure vessel above the liquid layer of the second liquid, the gas in fluid communication with the gas inlet/outlet; and a pump in fluid communication with the liquid inlet/outlet of the pressure vessel, whereby the first liquid can be pumped into the pressure vessel.

Preferably, the gas is immiscible with the second liquid.

Preferably, the first liquid is an aqueous solution.

Preferably, the first liquid is an aqueous salt solution.

Preferably, the second liquid is an oil.

Preferably, the second liquid is a mineral oil.

Preferably, a volume of the liquid layer of the second liquid comprises less than 5% of the volume of the pressure vessel.

Preferably, a volume of the liquid layer of the second liquid comprises less than 1% of the volume of the pressure vessel.

Preferably, the system further comprises a liquid storage tank in fluid communication with the liquid inlet/outlet of the pressure vessel, wherein the pump pumps the first liquid from the liquid storage tank and into the pressure vessel.

Preferably, the system further comprises a compressor in fluid communication with the gas inlet/outlet port, whereby the gas can be received from a supply line and compressed into the pressure vessel.

Preferably, a coalescer filter is in fluid communication with the pressure vessel and functions as a filter to remove traces of the second liquid from the gas after the gas exits the pressure vessel and returns the second liquid to the pressure vessel.

Preferably, the system further comprises a plurality of pressure vessels, each pressure vessel having the first liquid at least partially filling the pressure vessel; a liquid layer of the second liquid floating on top of the first liquid in each pressure vessel; and the gas at least partially filling each pressure vessel above the liquid layer of the second liquid, the gas in fluid communication with a gas inlet/outlet.

Preferably, the plurality of pressure vessels are adapted be filled simultaneously with the gas from a single gas line connected in parallel to each vessel in the plurality of vessels.

Preferably, each vessel in the plurality of pressure vessels is in fluid communication with the pump and with the liquid storage tank.

BRIEF DESCRIPTION OF THE DRAWINGS

To assist in understanding the invention and to enable a person skilled in the art to put the invention into practical effect, preferred embodiments of the invention are described below by way of example only with reference to the accompanying drawings, in which.

Figure 1:
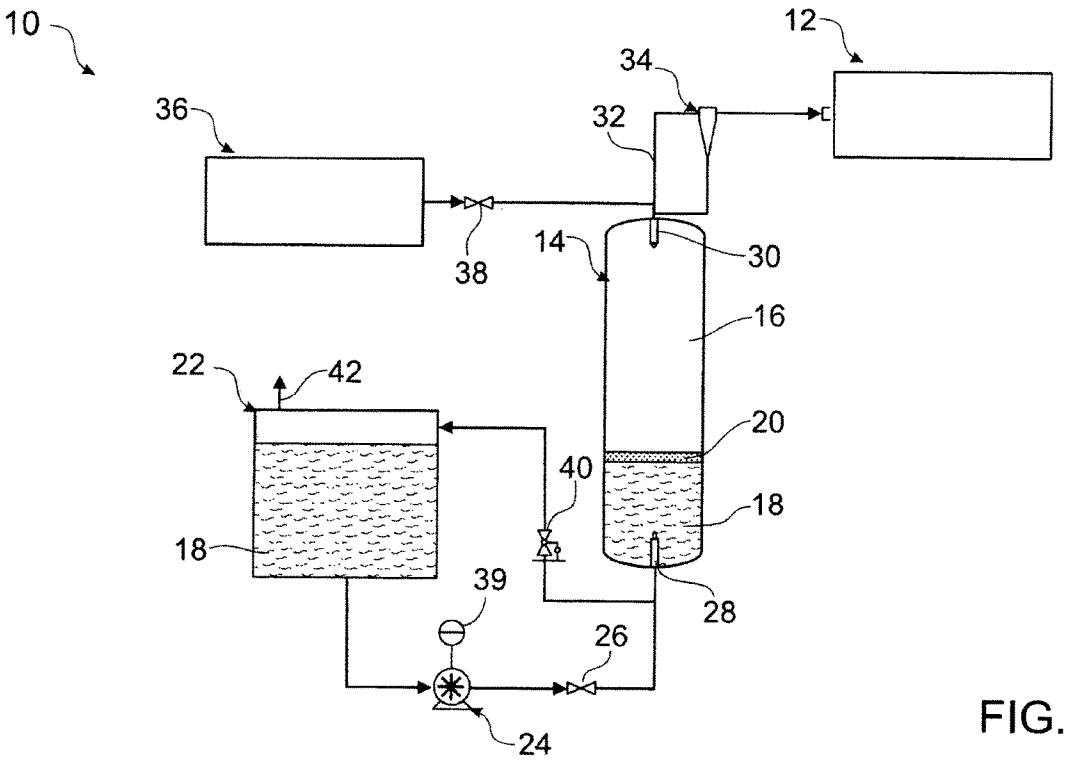
FIG. 1 illustrates a pressure vessel refueling system that supplies gas at high pressure to a gas dispenser, according to an embodiment of the present invention.

Those skilled in the art will appreciate that minor deviations from the layout of components as illustrated in the drawings will not detract from the proper functioning of the disclosed embodiments of the present invention.

DETAILED DESCRIPTION OF THE PREFERRED EMBODIMENT

Embodiments of the present invention comprise systems and methods for refueling compressed gas pressure vessels using a liquid piston. Elements of the invention are illustrated in concise outline form in the drawings, showing only those specific details that are necessary to the understanding of the embodiments of the present invention, but so as not to clutter the disclosure with excessive detail that will be obvious to those of ordinary skill in the art in light of the present description.

In this patent specification, adjectives such as first and second, left and right, front and back, top and bottom, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

According to one aspect, the invention includes a pressure vessel refueling system. The system includes a pressure vessel having a gas inlet/outlet port and a liquid inlet/outlet port, a first liquid at least partially filling the pressure vessel, and a liquid layer of a second liquid floating on top of the first liquid. The first liquid is non-miscible with the second liquid, such that the liquid layer forms a "liquid piston" that is displaced up and down in the vessel as gas is added to and then expelled from the vessel. A liquid storage tank is in fluid communication with the liquid inlet/outlet of the pressure vessel, and a pump is in fluid communication with the liquid storage tank. The first liquid thus can be pumped from the liquid storage tank into the pressure vessel to maintain the pressure vessel at a constant pressure as the gas is expelled from the vessel.

Advantages of the present invention include enabling fast fill refueling methods of CNG fuel tanks using reduced size primary compression and storage. The storage is maintained at a constant pressure as gas is discharged, providing opportunity for consistent high pressure filling of CNG fuel tanks. Other advantages include reducing a heat rise of the primary storage vessel during its refilling, by avoiding the heat of recompression in the vessel with the application of a back pressure. Further, due to the ability to maintain a constant high pressure in the primary storage vessel during refueling, a greater number of vehicle fuel tanks can be refueled simultaneously and faster, with lower peak power requirements, as the CNG is already compressed/produced and is simply transferred from storage to the vehicle fuel tank—thus minimising the size of gas and electric utility connections and the associated demand charges.

In this specification CNG cylinders that supply or store gaseous fuel are synonymously referred to as tanks, vessels, pressure vessels, CNG cylinders and cylinders.

FIG. 1 illustrates a pressure vessel refueling system 10 that supplies gas at high pressure to a gas dispenser 12. The system 10 includes a CNG primary storage vessel 14 that is partially filled with natural gas 16 and partially filled with an aqueous liquid 18. A thin layer of a second liquid in the form of an oil 20 floats on top of the aqueous liquid 18. Because the oil 20 is both immiscible with the aqueous liquid 18 and is less dense than the aqueous liquid 18, the layer of oil 20 functions as a "liquid piston" that moves up and down inside the vessel 14 as a volume of the aqueous liquid 18 in the vessel 14 changes.

The floating layer of oil 20 creates a barrier that prevents the aqueous liquid 18 from contacting and evaporating into the natural gas 16. In some cases the oil 20 may become saturated with the natural gas 16. However, because the oil 20 does not leave the storage vessel 14, and because only a thin layer of oil 20 is required (which becomes saturated with natural gas on initial fill), insignificant natural gas 16 is not available, or is lost from storage.

The system 10 further includes a liquid storage tank 22 and a pump 24. In use, for example when a CNG vehicle or a plurality of CNG vehicles are being refueled from the gas dispenser 12, the pump 24 pumps the aqueous liquid 18 through a check valve 26 and through a lower float valve 28 in a lower inlet/outlet port and into the vessel 14. Simultaneously, the natural gas 16 flows through an upper float valve 30 in an upper inlet/outlet port, through a gas line 32 and to the dispenser 12. As the aqueous liquid 18 enters the vessel 14 and the gas 16 exits the vessel 14, the layer of oil 20 rises in the vessel 14 and maintains a barrier between the gas 16 and the aqueous liquid 18.

The lower float valve 28 functions to prevent the gas 16 from exiting through the bottom of the vessel 14 in the event that all of the aqueous liquid 18 is drained from the vessel 14. Similarly, the upper float valve 30 functions to prevent the aqueous liquid 18 from exiting through the top of the vessel 14 in the event that all of the gas 16 is pushed out of the vessel 14 by the layer of oil 20 rising to the top of the vessel 14. As an example, the lower float valve 28 and the upper float valve 30 can function as described in international patent application no. PCT/AU2012/000265, titled Compressed Natural Gas Tank Float Valve System and Method published on 20 Sep. 2012 under International Publication No. WO2012/122599, the contents of which are hereby incorporated in their entirety.

During the refueling process, for example of a vehicle fuel tank connected to the dispenser 12, a coalescer filter 34 functions as a filter to remove traces of the oil 20 from the gas 16 before such traces reach the dispenser 12. It is normal in the CNG industry to use such filtration methods to remove trace compressor oil. However, unlike in a compressor, the oil-gas interface is essentially static and does not entrain oil in the gas. Thus the layer of oil 20 enables a significantly more efficient gas transfer system, even though traces of the oil 20 may require filtering by the coalescer 34.

When re-filling the CNG storage vessel 14 with natural gas 16, or while re-fuelling a vehicle using the dispenser 12, a gas compressor 36 can be activated to allow the gas 16 to be compressed and supplied via a check valve 38 from a natural gas supply line (not shown) either into the storage vessel 14 or directly to the dispenser 12.

A pressure controller 39 enables the pump 24 to be activated automatically when a pressure drop is detected in the storage vessel 14. Working simultaneously with the gas compressor 36, the pump 24 enables a high flow rate of gas to be delivered to the dispenser 12; that in turn enables, for example, multiple CNG fuel tanks/vehicles to be refueled simultaneously from the dispenser 12 or a plurality of dispensers.

By displacing the already compressed natural gas 16 from storage 14 at constant high pressure to the dispenser 12, the steady state power needed by the system 10 to maintain a constant maximum output of gas 16 from the dispenser 12 can be reduced by up to an order of magnitude when compared to using online CNG compression to meet the required delivery rate, from conventional industrial natural gas supply pressures. That means, for example, when refueling several CNG vehicles simultaneously from the dispenser 12, The compressor 36 can be much smaller than would be required in a comparable refueling system that did not maintain or use a CNG storage vessel at a constant pressure using liquid displacement of the stored gas. According to the present invention the full amount of stored gas is available and deliverable at several times the rate that would otherwise be possible using the equivalent power applied only to a gas compressor.

During refilling of the vessel 14 with the gas 16, as the gas 16 is compressed into the vessel 14, the layer of oil 20 applies pressure to the aqueous liquid 18 and opens a back pressure valve 40. The aqueous liquid 18 then flows through the back pressure valve 40 and back into the liquid storage tank 22. As the liquid level rises in the storage tank 22, air in the tank 22 is vented to atmosphere through a vapour vent 42.

Figure 2:
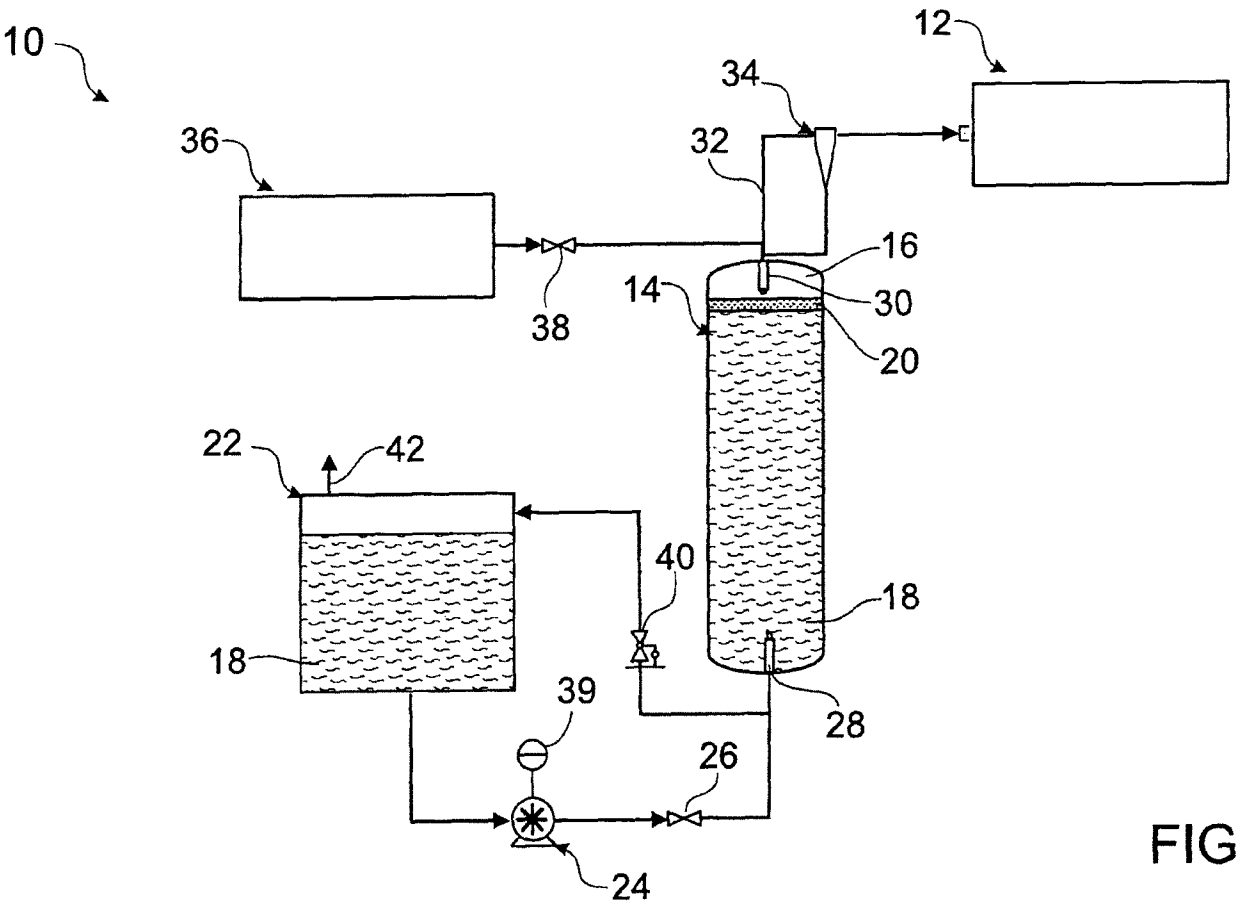
FIG. 2 is a further illustration of the pressure vessel refueling system of FIG. 1, wherein the CNG storage vessel is almost empty of gas, according to an embodiment of the present invention.

FIG. 2 is a further illustration of the pressure vessel refueling system 10, wherein the CNG storage vessel 14 is almost empty of gas 16. A considerable volume of aqueous solution 18 has therefore been pumped by the pump 24 from the liquid storage tank 22 into the vessel 14, enabling the small volume of gas 16 in the vessel 14 to remain at or near a full operating pressure, such as 5000 psig.

As the layer of oil 20 reaches the upper float valve 30, the pump 24 is deactivated and the storage vessel 14 is considered to be empty of gas 16 and in need of re-filling. A volumetric analysis of the flow through the pump 24 can be used to determine that the vessel 14 is nearly empty of gas 16 and full of the aqueous solution 18. However, the upper float valve 30 can be used as a safety mechanism to ensure that the layer of oil 20 is not pumped out of the storage vessel 14.

Figure 3:
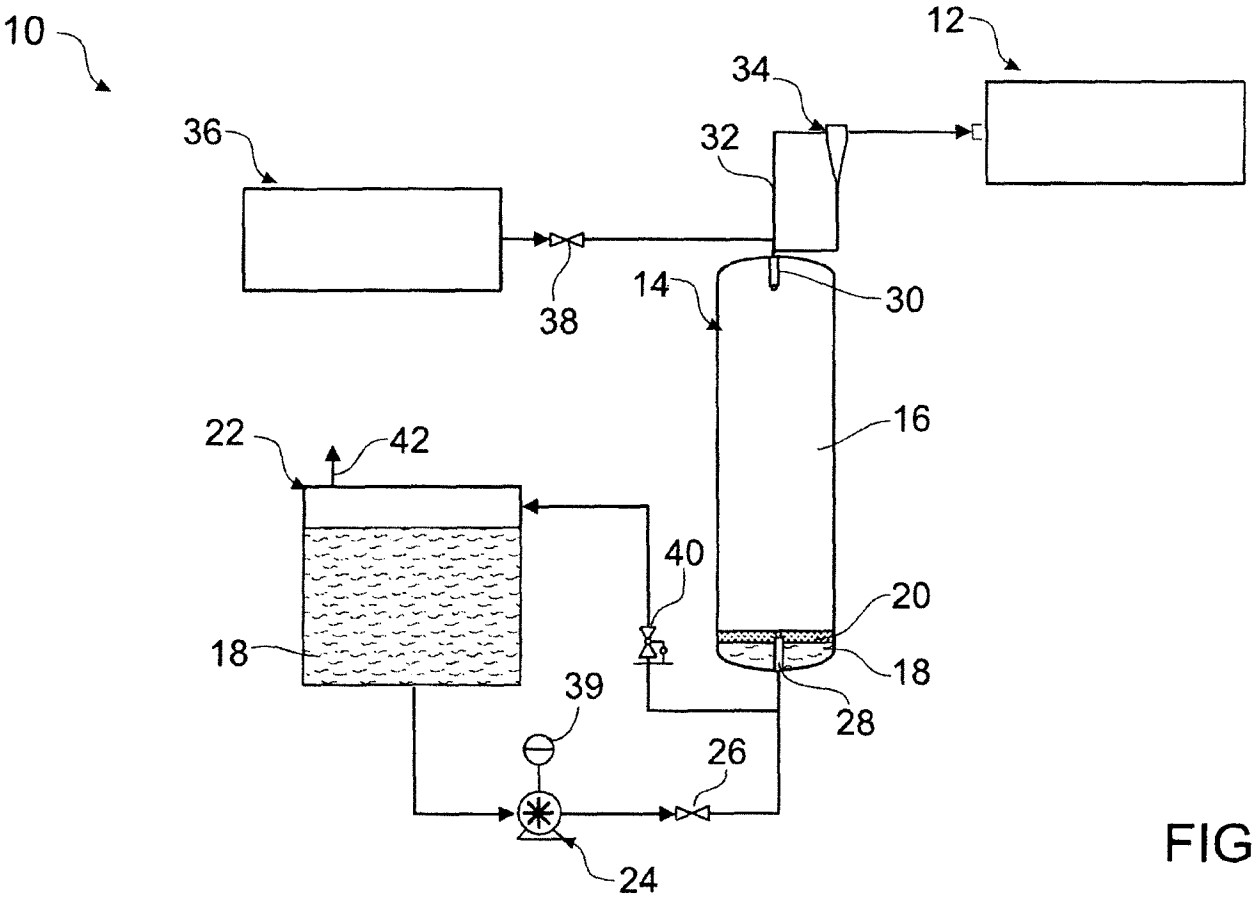
FIG. 3 is yet a further illustration of the pressure vessel refueling system of FIG. 1, wherein the CNG storage vessel is almost entirely full of gas.

FIG. 3 is yet a further illustration of the pressure vessel refueling system 10, wherein the CNG storage vessel 14 is almost entirely full of gas 16. As the layer of oil 20 drops to the level of the lower float valve 28, the storage vessel 14 is considered to be full of gas 16. A volumetric analysis of the volume of aqueous solution 18 in the storage tank 22 can be used to determine that the vessel 14 is full of gas 16 and nearly empty of the aqueous solution 18. However, the lower float valve 28 can be used as a safety mechanism to ensure that the layer of oil 20 is not pumped out of the storage vessel 14 and into the storage tank 22. The lower float valve includes a plug (not shown) that sinks in the oil 20 but floats in the aqueous solution 18—thus retaining the oil 20 in the vessel 14.

According to some embodiments, the aqueous solution 18 is non-gas miscible and the oil 20 is immiscible in water. The aqueous solution 18 thus can move in and out of the pressurized storage vessel 14 without carrying dissolved gas 16. The aqueous solution 18 can be, for example, a salt solution to act as an anti-freeze and hydrate formation suppressant to prevent solids forming in the system 10. Also, various types of non-water miscible fluids can be used as the oil 20, such as various mineral oils or organic oils.

Those skilled in the art will further appreciate that the single storage vessel 14 can be replaced by a plurality of vessels operating in parallel both when being refilled with the gas 16 and when discharging the gas 16. Thus each pressure vessel in the plurality of vessels will include a layer of the oil 20 floating on top of the aqueous solution 18, and will operate as described herein concerning the vessel 14. Use of such a plurality of vessels enables significantly greater gas storage capacity in a single system 10.

In summary, advantages of the present invention include enabling fast fill refueling methods of CNG fuel tanks by utilising the full capacity of the installed storage and delivering that storage using substantially less power than that required by equivalent gas compression plant to meet peak demands. The storage is maintained at a constant pressure as gas is discharged enabling complete filling of tanks/vehicles. The system thus minimises the size of gas and electric utility connections and the associated demand charges. This leverages the delivery capacity of CNG fuelling stations that are limited by utility connections and can make sizable CNG stations feasible where only limited utility connections exist.

Also, the present invention can eliminate the issue of in cylinder recompression heating inside CNG storage cylinders when filling the storage, enabling consistent filling to a pressure vessel's standard ambient temperature pressure rating at design pressures. This provides increased CNG storage or the opportunity to reduce storage vessel sizes.

Also, eliminating the heat of compression inside a CNG storage vessel during re-filling increases safety, particularly by preventing transient temperature excursions during re-filling of storage, thereby allowing for the potential to redesign composite storage vessel cylinders to be lower cost.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

The invention claimed is:

1. A pressure vessel refueling system, comprising:

a compressed natural gas (CNG) refueling pressure vessel having a gas inlet/outlet port and a liquid inlet/outlet port;

a first liquid comprising an aqueous salt solution acting as both an anti-freeze and hydrate formation suppressant at least partially filling the pressure vessel;

a liquid layer of a second liquid floating on top of the first liquid, wherein the second liquid is immiscible with the first liquid;

a natural gas at least partially filling the pressure vessel above the liquid layer of the second liquid, the natural gas in fluid communication with the gas inlet/outlet, and wherein the natural gas is immiscible with the second liquid;

a pump in fluid communication with the liquid inlet/outlet of the pressure vessel, whereby the first liquid can be pumped into the pressure vessel; and a compressor in fluid communication with the gas inlet/outlet port, whereby the natural gas can be received from a natural gas supply line and compressed into the pressure vessel.

2. The pressure vessel refueling system of claim 1, wherein the second liquid is an oil.

3. The pressure vessel refueling system of claim 1, wherein the second liquid is a mineral oil.

4. The pressure vessel refueling system of claim 1, wherein a volume of the liquid layer of the second liquid comprises less than 5% of the volume of the pressure vessel.

5. The pressure vessel refueling system of claim 1, wherein a volume of the liquid layer of the second liquid comprises less than 1% of the volume of the pressure vessel.

6. The pressure vessel refueling system of claim 1, further comprising a liquid storage tank in fluid communication with the liquid inlet/outlet of the pressure vessel, wherein the pump pumps the first liquid from the liquid storage tank and into the pressure vessel.

7. The pressure vessel refueling system of claim 1, wherein a coalescing filter is in fluid communication with the pressure vessel and functions as a filter to remove particles of the second liquid from the natural gas after the natural gas exits the pressure vessel and returns the second liquid to the pressure vessel.

8. The pressure vessel refueling system of claim 1, further comprising a plurality of pressure vessels, each pressure vessel having:

the first liquid at least partially filling the pressure vessel;

a liquid layer of the second liquid floating on top of the first liquid in each pressure vessel; and the natural gas at least partially filling each pressure vessel above the liquid layer of the second liquid, the natural gas in fluid communication with a gas inlet/outlet.

9. The pressure vessel refueling system of claim 7, wherein the plurality of pressure vessels are adapted to be filled simultaneously with the natural gas from a single gas line connected in parallel to each vessel in the plurality of vessels.

10. The pressure vessel refueling system of claim 7, wherein each vessel in the plurality of pressure vessels is in fluid communication with the pump and with a liquid storage tank.

11. A pressure vessel refueling system, comprising:

a pressure vessel having a gas inlet/outlet port and a liquid inlet/outlet port;

a first liquid at least partially filling the pressure vessel;

a liquid layer of a second liquid floating on top of the first liquid, wherein the second liquid is immiscible with the first liquid;

a natural gas at least partially filling the pressure vessel above the liquid layer of the second liquid, the gas in fluid communication with the gas inlet/outlet;

a pump in fluid communication with the liquid inlet/outlet of the pressure vessel, whereby the first liquid can be pumped into the pressure vessel;

a compressor in fluid communication with the gas inlet/outlet port, whereby the natural gas can be received from a natural gas supply line and compressed into the pressure vessel; and a coalescing filter in fluid communication with the pressure vessel and functioning as a filter to remove particles of the second liquid from the natural gas after the natural gas exits the pressure vessel and returns the second liquid to the pressure vessel.

* * * * *